United States Patent [19]

Sternhagen

[11] Patent Number: 4,796,887

[45] Date of Patent: Jan. 10, 1989

[54] BOWLING LANE GUTTER

[75] Inventor: David A. Sternhagen, Green Bay, Wis.

[73] Assignee: D & H Bowling Supply, Inc., DePere, Wis.

[21] Appl. No.: 885,238

[22] Filed: Jul. 14, 1986

[51] Int. Cl.[4] ..... A63D 1/04

[52] U.S. Cl. ..... 273/51; 193/2 R; 273/DIG. 4

[58] Field of Search ..... 273/51, DIG. 4; 193/2 R, 25 R

[56] References Cited

U.S. PATENT DOCUMENTS 2,896,761 7/1959 Grant et al. ..... 193/2 R
3,069,165 12/1962 Kessler ..... 273/51 X
3,279,795 10/1966 Larson ..... 273/51
4,362,231 12/1982 Meyer ..... 193/2 R
4,529,660 7/1985 Heim ..... 193/2 R X

*Primary Examiner*—Anton O. Oechsle
*Attorney, Agent, or Firm*—Andrus, Sceales, Starke & Sawall

[57] ABSTRACT

A gutter structure has a trough-like gutter substrate positioned adjacent the bowling lane. A sheet of high density polyethylene material is applied to the upwardly exposed surface of the substrate so as to provide a highly durable finish to the gutter that is not harmed by lane cleaning agents. One edge of the high density polyethylene sheet may be stapled in a countersunk fashion to secure the liner to the substrate. The other edge may be tucked under the lane divider cap. The liner may be glued to the substrate at either end to avoid tearing away of the liner from the substrate.

14 Claims, 2 Drawing Sheets

FIG. 1
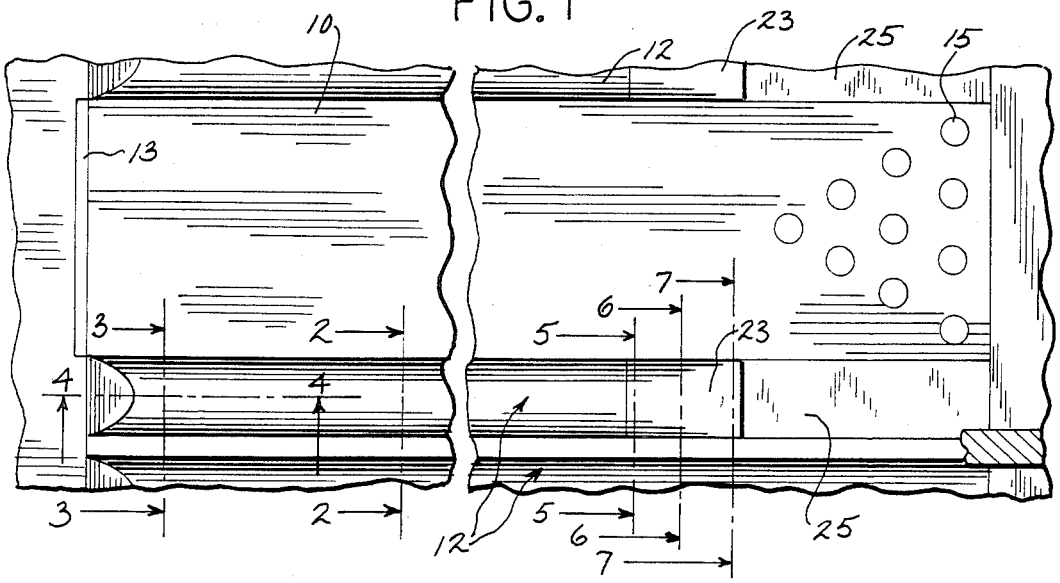
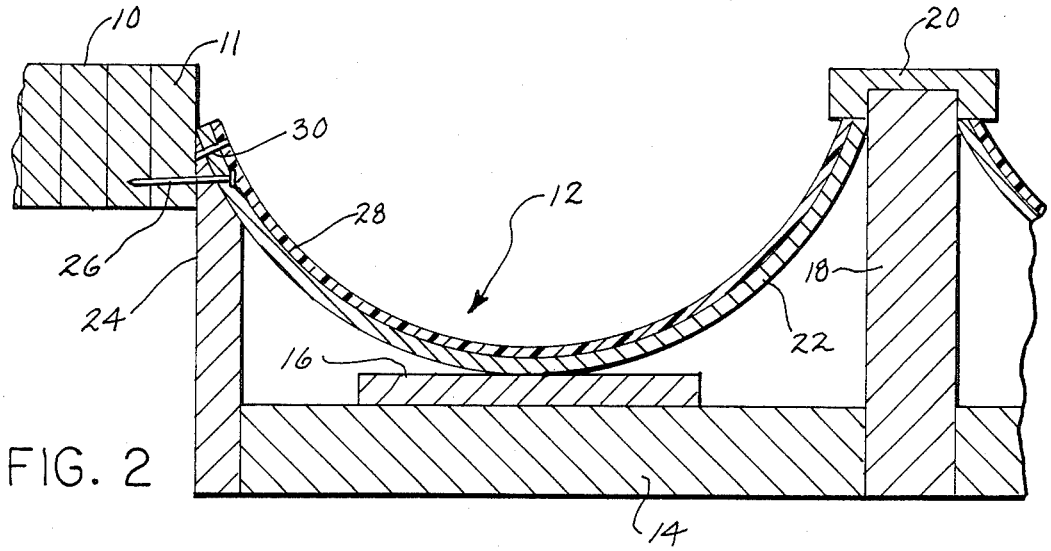
FIG. 2
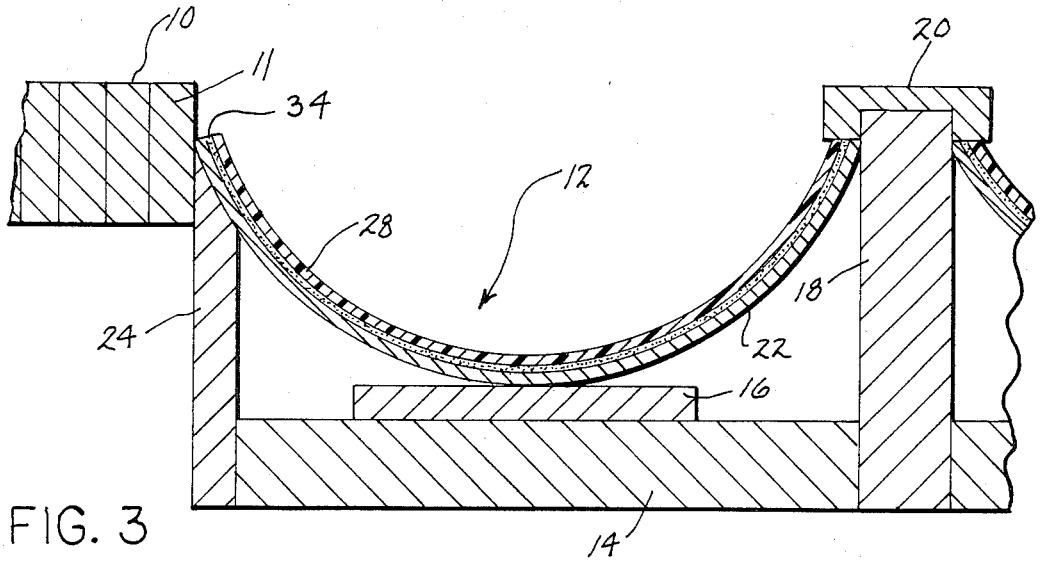
FIG. 3

BOWLING LANE GUTTER

The present invention relates to an improved construction for the gutters found on either side of a bowling lane.

Bowling lane gutters receive bowling balls misdirected off the bowling lane. The balls roll down the gutter to the pin end of the lane for return to the bowler.

Bowling lane gutters are typically formed of a molded plywood trough nailed to the side of the bowling lane. The gutter is painted for protective and esthetic purposes. However the agents used for the periodic cleaning and resurfacing of the bowling lane act as solvents to the paint in the gutters. This causes the gutters to become unsightly and requires frequent repainting. Also, due to the vibration occurring on the lane and gutters during play, the nails holding the gutter trough to the side of the bowling lane may back out and protrude into the gutter. This damages the bowling balls as they roll down the gutter.

Bowling lane gutters have also been formed of preformed sections of vinyl coated steel. However, the lane cleaning and refinishing chemicals remove the plasticizer from the vinyl, causing it to loose its smooth finish. The fasteners for the sections may loosen and protrude into the gutter so as to cause damage to passing bowling balls.

An extruded plastic gutter, formed in sections, has also been proposed but is not believed to have been widely accepted.

It is, therefore, the object of the present invention to provide an improved bowling lane gutter structure that avoids the shortcomings of the structures heretofore used or contemplated.

More specifically, it is object of the present invention to provide a gutter structure having a construction and finish that is both durable and highly pleasing in appearance. The gutter structure is not harmed by conventional lane cleaning agents and avoids the damage to bowling balls heretofore encountered by fasteners backing out into the gutter.

Briefly, the present invention contemplates a gutter structure having a trough-like gutter substrate positioned adjacent a side of the bowling lane. A sheet of polyethylene material, preferably high density polyethylene material, is applied to the upwardly exposed surface of the substrate so as to provide a highly durable finish to the gutter that is not harmed by lane cleaning agents. One edge of the polyethylene sheet may be stapled in a countersunk fashion to secure the liner to the substrate. The other edge may be tucked under the lane divider cap. The liner may be glued to the substrate at either end to avoid tearing away of the liner from the substrate. The use of a single sheet of polyethylene and the countersunk staple minimizes damage to bowling balls.

The polyethylene sheet may comprise a single strip having dimensions corresponding to the length and the curved width of the gutter. A sheet .050 inches thick has been found suitable for use as the gutter liner. The polyethylene material may be pigmented, if desired, to further improve the esthetics of the gutter.

The invention will be further understood by reference to the following detailed description taken in conjunction with the drawing. In the drawing:

FIG. 1 is a plan view of a bowling lane and associated gutters;

FIG. 2 is a cross-sectional view of a bowling lane gutter taken along the line 2—2 of FIG. 1, generally showing the gutter construction of the present invention;

FIG. 3 is a cross-sectional view taken along the line 3—3 of FIG. 1 showing the construction of the gutter structure of the present invention adjacent the foul line end of the bowling lane;

Figure 4:
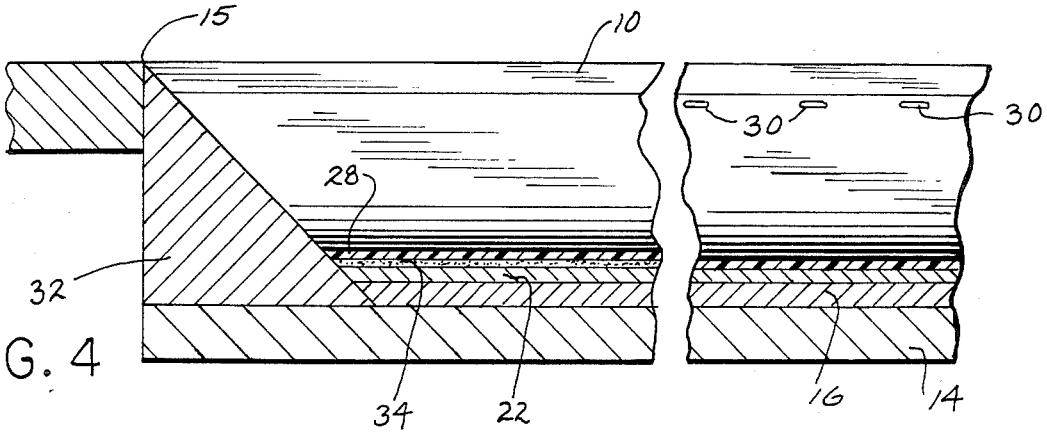
Figure 5:
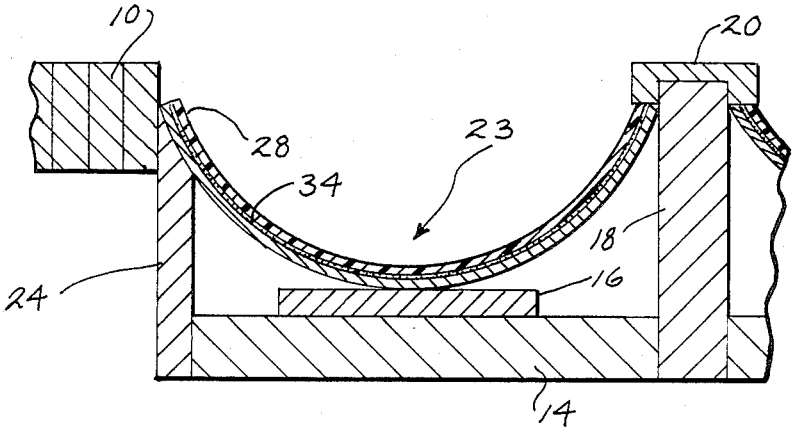
Figure 6:
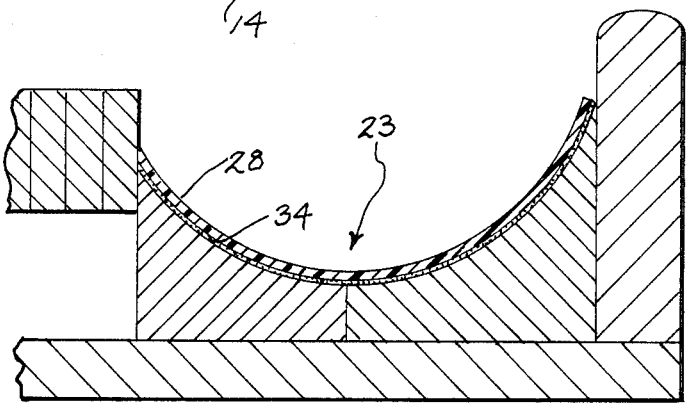
Figure 7:
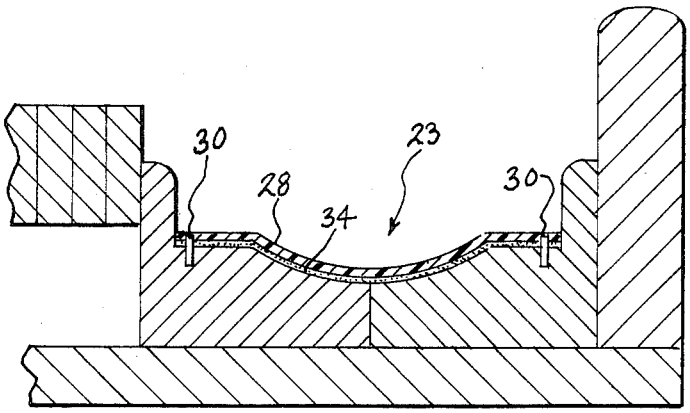

FIG. 4 is a cross-sectional view taken along the line 4—4 of FIG. 1 further showing the construction of the gutter structure of the present invention adjacent the foul line end of the bowling lane; and FIGS. 5, 6, and 7 are cross-sectional view taken along the lines 5—5, 6—6, and 7—7, respectively, of FIG. 1, showing a transition section of the gutter structure at the pin end of the bowling lane.

FIG. 1 shows bowling lane 10 having gutter 12 on either side thereof. Lane 10 may be formed of a plurality of edge glued strips of wood 11. The playing surface of lane 10 has foul line 13 at one end thereof and bowling pins 15 at the other end. Gutter 12 is supported by a substrate 14 and may rest on a strip of sound deadening material 16, such as cellulose insulation. The gutters of adjacent lanes are contiguous, as shown in FIG. 1. The contiguous gutters 12 are separated by divider 18 having an overhanging cap 20. In some cases, a ball return channel may be provided in the construction of divider 18.

Gutter 12 typically includes a molded plywood trough 22 extending from foul line 13 to a transition piece 23 at the pin end of lane 10. Gutter trough 22 is secured to lane 10 by nailing trough 22 and support 24 to the lane with nails 26. Transition piece 23 connects trough 22 to flat gutter 25 in the pin setting machine (not shown).

In accordance with the present invention, a sheet 28 of plastic is applied to the upper, exposed surface of trough 22. The plastic may be polyethylene, preferably high density polyethylene. Sheet 28 may be formed as a strip sufficiently long to extend from foul line 13 through transition piece 23, i.e. about 60 feet long. The strip may be about 11¼ inches wide and about 0.050 inches thick. The strip is placed in trough 22. The edge of sheet 28 away from lane 10 is inserted or tucked under cap 20 of divider 18. Sheet 28 is bent to the curvature of trough 22 and the edge of the sheet adjacent lane 10 stapled to the trough by staples 30. Staples 30 may be inserted about every eighteen inches along the length of sheet 28. The edge of sheet 28 under cap 20 is held there by the resilience of sheet 28 deformed into trough 22, although the edge may be stapled or otherwise fastened, if desired.

As shown most clearly in FIG. 4, one end of sheet 28 may be cut to accommodate slanting block 32 at the foul line 13 end of lane 10. Sheet 28 may be glued to trough 22 adjacent foul line 15, as shown in exaggerated fashion in FIGS. 3 and 4 by glue 34. This avoids tearing away of sheet 28 during play or cleaning of lane 10. It also avoids the need for staples 30 in this area, thereby improving the appearance of gutter 12. The first eighteen inches of strip of sheet 28 immediately adjacent the foul line may be glued to trough 22. Sheet 28 may also be glued through transition piece 23, as shown in FIGS. 5, 6, and 7. Sheet 28 may stop at the end of transition piece 23 and typically does not extend into flat gutter 25 of the pin setting machine. An adhesive, such as that made and sold by the 3M Co. of St. Paul, Minn., under the designation "Spray 90" may be used to glue sheet 28 to trough 22.

As shown in FIG. 2, sheet 28 covers nails 26, preventing the nails from backing out and damaging bowling balls moving in gutter 12. Staples 30 compress the plastic of sheet 28 when driven into the sheet, thereby becoming countersunk, to avoid contact with the bowling balls. A bowling ball in the gutter tends to ride along the edge of lane 10 if dislodged laterally from the center of gutter 12, tending to avoid the area of staples 30 along the edge of sheet 28 entirely.

As noted above, sheet 28 may be formed of high density polyethylene. The sheet may be extruded. Sheet 28 is installed in gutter 12 with the direction in which the sheet was extruded lying parallel to the length of gutter 12. A desired orientation of the material of sheet 12 is thus provided. The polyethylene may typically have a density of 0.96 g/cc or greater. A polyethylene material suitable for use in the present invention in that made and sold by the Chemplex Company of Rolling Meadows, Ill. under the designation 6001. This material has a density of 0.96 g/cc and a melt index of 0.15. The polyethylene may be pigmented, if desired, to provide various colors to gutter 12. An ultraviolet filter is provided in the material when lighter color pigments are utilized.

The polyethylene material of sheet 28 is not harmed by the cleaning agents used during cleaning and refinishing of bowling lane 10 so that gutter 12 retains a pleasing appearance during an extended service life.

Various modes of carrying out the invention are contemplated as being within the scope of the following claims particularly pointing out and distinctly claiming the subject matter which is regarded as the invention.

I claim:

1. A gutter structure for a bowling lane comprising:

an elongated gutter substrate positioned adjacent a side of the bowling lane, said substrate having a generally concave configuration suitable for receiving a bowling ball, said substrate having an upwardly exposed surface; and a single sheet of polyethylene material applied to said upwardly exposed surface of said substrate and running the length of said elongated gutter substrate, said single sheet covering the gutter substrate; and a plurality of fastener means along one edge of the gutter substrate and sheet, said fastener means being spaced in the direction of elongation of said gutter substrate and recessed below the surface of said sheet of polyethylene material.

2. The gutter structure according to claim 1 wherein said sheet is further defined as a sheet of high density polyethylene material.

3. The gutter structure according to claim 2 wherein said high density polyethylene material of said sheet has a density of approximately 0.96 g/cc or greater.

4. The gutter structure according to claim 2 wherein said sheet of polyethylene material is further defined as extruded material and wherein said sheet is applied so that the direction of extrusion runs parallel to the elongation of the gutter substrate.

5. The gutter structure according to claim 1 wherein said fastener means comprises a plurality of staples along one edge of the gutter substrate and sheet, said staples being spaced in the direction of elongation of said gutter substrate and recessed below the surface of said sheet of polyethylene material.

6. The gutter structure according to claim 5 wherein said sheet is secured by said staples along the edge adjacent the bowling lane.

7. A gutter structure according to claim 5 for a bowling lane with a divider means, said gutter structure being located intermediate said bowling lane and divider means, said divider means having an overhanging cap means, wherein the edge of said sheet adjacent said divider means is placed beneath the overhang of said cap and retained there by the resiliency of the polyethylene material.

8. A gutter structure according to claim 1 for a bowling lane with a divider means, said gutter structure being located intermediate said bowling lane and divider means, said divider means having an overhanging cap means, wherein the edge of said sheet adjacent said divider means is placed beneath the overhang of said cap and retained there by the resiliency of the polyethylene material.

9. A gutter structure according to claim 1 wherein said sheet of polyethylene material is glued to said gutter substrate adjacent at least one end.

10. The gutter structure according to claim 9 wherein said sheet of polyethylene material is glued to said gutter substrate adjacent both ends of said sheet.

11. The gutter structure according to claim 1 wherein said sheet of polyethylene material is further defined as extruded material and wherein said sheet is applied so that the direction of extrusion runs parallel to the elongation of the gutter substrate.

12. The gutter structure according to claim 1 wherein said sheet of polyethylene material is pigmented.

13. A gutter structure for a bowling lane comprising:

an elongated gutter substrate positioned adjacent a side of the bowling lane, said substrate having a generally concave configuration suitable for receiving a bowling ball, said substrate having an upwardly exposed surface; and a single sheet of high density extruded polyethylene material applied to said upwardly exposed surface of said substrate for covering the gutter substrate, said sheet being applied so that the direction of extrusion of said sheet runs parallel to the elongation of said gutter substrate, said sheet being glued to said gutter substrate adjacent both ends of said sheet, at least one edge of the portion of said sheet intermediate the ends therof being secured to said substrate by staples recessed below the surface of said sheet of polyethylene material, said staples being spaced in the direction of elongation of said gutter substrate.

14. The gutter structure according to claim 13 for a bowling lane with a divider means, said gutter structure being located intermediate said bowling lane and divider means, said divider means having an over-hanging cap means, wherein the edge of said sheet adjacent the bowling lane is secured by said staples, and wherein the edge of said sheet adjacent said divider means is placed beneath the overhang of said cap and retained there by the resiliency of said high density polyethylene material.

* * * * *